US012275047B2

(12) United States Patent
Kirchner et al.

(10) Patent No.: US 12,275,047 B2
(45) Date of Patent: Apr. 15, 2025

(54) DEVICE AND METHOD FOR HANDLING MANDREL RODS IN A TUBE ROLLING MILL

(71) Applicant: SMS group GmbH, Düsseldorf (DE)

(72) Inventors: Walter Kirchner, Viersen (DE); Paolo Marin, Vigevano (IT); Patrizio Rinaldi, Bareggio (IT)

(73) Assignee: SMS group GmbH, Düsseldorf (DE)

( * ) Notice: Subject to any disclaimer, the term of this patent is extended or adjusted under 35 U.S.C. 154(b) by 328 days.

(21) Appl. No.: 18/020,926

(22) PCT Filed: Jun. 30, 2021

(86) PCT No.: PCT/EP2021/067964
§ 371 (c)(1),
(2) Date: Feb. 11, 2023

(87) PCT Pub. No.: WO2022/033760
PCT Pub. Date: Feb. 17, 2022

(65) Prior Publication Data

US 2023/0201900 A1 Jun. 29, 2023

(30) Foreign Application Priority Data

Aug. 12, 2020 (DE) ..... 10 2020 210 233.3

(51) Int. Cl.
*B21B 25/02* (2006.01)
*B21B 17/04* (2006.01)

(52) U.S. Cl.
CPC ..... *B21B 25/02* (2013.01); *B21B 17/04* (2013.01)

(58) Field of Classification Search
CPC ..... B21B 17/02; B21B 17/04; B21B 17/06; B21B 21/005; B21B 23/00; B21B 25/00; B21B 25/02
See application file for complete search history.

(56) References Cited

U.S. PATENT DOCUMENTS 1,964,507 A 6/1934 Diescher
4,578,974 A * 4/1986 Pozsgay ..... B21B 23/00 72/97

(Continued)

FOREIGN PATENT DOCUMENTS

DE 1427915 A1 8/1969
DE 3231071 A1 3/1984

(Continued)

*Primary Examiner* — Edward T Tolan
(74) *Attorney, Agent, or Firm* — Smartpat PLC

(57) ABSTRACT

A device for handling mandrel rods in a rolling plant for rolling seamless tubes comprises an inserter. The inserter moves a mandrel rod in a rolling direction such that the mandrel rod, starting from an initial state, is pushed into a tube blank situated upstream of the mandrel rod. A retaining device has a fixing unit that is movable along the rolling line and is designed to temporarily hold the mandrel rod at an action point at a rear end of the mandrel rod and to carry out a working stroke. The mandrel rod can be inserted into the rolling mill in the rolling direction and pulled out of the rolling mill counter to the rolling direction by the retaining device. The retaining device is designed such that the starting position of the fixing unit lies between the two ends of the mandrel rod in the initial state.

19 Claims, 4 Drawing Sheets

(56) References Cited

U.S. PATENT DOCUMENTS

| | | | | |
|---|---|---|---|---|
| 9,616,476 | B2 * | 4/2017 | Winterfeldt | B21B 23/00 |
| 9,789,522 | B2 * | 10/2017 | Hoeffgen | B21B 17/02 |
| 10,632,514 | B2 * | 4/2020 | Strank | B21C 3/08 |
| 2013/0008219 | A1 | 1/2013 | Cernuschi et al. | |
| 2013/0061646 | A1 | 3/2013 | Cernuschi et al. | |

FOREIGN PATENT DOCUMENTS

| | | | | |
|---|---|---|---|---|
| DE | 2742288 | C2 | | 5/1988 |
| EP | 2683500 | A1 | | 9/2012 |
| EP | 2694227 | B1 | | 9/2015 |
| JP | S574310 | A | | 1/1982 |
| JP | 59-4907 | A | * | 1/1984 |
| JP | 61-249607 | A | * | 11/1986 |
| JP | 03-169408 | A | * | 7/1991 |

* cited by examiner

DEVICE AND METHOD FOR HANDLING MANDREL RODS IN A TUBE ROLLING MILL

TECHNICAL FIELD

The disclosure relates to a device for handling mandrel rods in a rolling mill for rolling seamless tubes. The disclosure further relates to a rolling plant and a method for rolling seamless tubes.

BACKGROUND

In the production of seamless tubes, elongating rolling mills, in which tube blanks are rolled out on long cylindrical mandrel rods, are used. For this purpose, a mandrel rod is threaded into the tube blank before the actual rolling process and, together with the tube blank, is passed through a rolling mill with a plurality of rolling stands arranged one behind the other, as a result of which a reduction in wall thickness and thus an elongation of the tube blank on the mandrel rod take place. After the tube blank has passed through the rolling stands, it is now rolled out into the desired tube or semi-finished product, the mandrel rod is pulled back counter to the rolling direction by means of a mandrel rod retaining device and out of the line of the rolling stands.

Inserting the tube blank to be rolled into the rolling line by means of a transverse transport, in such a manner that it is coaxial to the rolling axis at a flush line upstream of the rolling mill, is known. The mandrel rod required for forming the rolled product is also inserted into the rolling line via a transverse transport. By means of an inserter and, if necessary, using the mandrel rod retaining device, the mandrel rod, coated with a lubricant, is inserted into the tube blank.

Such a mechanism with mandrel rod retraining device is described, for example, in DE 27 42 288 C2. Alternatively, solutions in which the pre-threaded mandrel rod is lifted into the rolling line together with the rolled product are known.

If the mandrel rod is threaded into the tube blank in the rolling line, the required axial stroke of the mandrel rod retaining device results from the rolled product length and the mandrel rod length. The mandrel rod retaining device must be retracted into the rolled product during the main time of the machine cycle, which is contrary to a higher cycle frequency, thus contrary to an increase in the productivity of the plant. Solutions with which the mandrel rod is pre-threaded next to the rolling line have technological disadvantages, for example a temperature loss of the rolled product due to a longer contact time with the mandrel rod.

SUMMARY

One object of the disclosure is to improve the rolling of seamless tubes, in particular to increase the productivity of a rolling plant for rolling seamless tubes.

The object is achieved with a device as described herein; a rolling plant as described herein; along with a method as described herein.

The device is used for handling mandrel rods in a rolling plant for rolling seamless tubes. The rolling plant comprises a rolling mill, typically with a plurality of rolling stands arranged one behind the other in a rolling direction, which is designed for rolling out a tube blank, also referred to herein as "rolled material," "rolled product" or "workpiece," on such a mandrel rod to form a tube. For example, the tube can be made of steel or a non-ferrous metal.

The device comprises an inserter that is designed to move or advance, as the case may be, a mandrel rod arranged in a rolling line in the rolling direction, such that the mandrel rod is pushed or threaded, as the case may be, into a tube blank arranged in the rolling direction in front of (i.e., downstream of) the mandrel rod. The state in which the mandrel rod and the tube blank are arranged one behind the other in the rolling line, that is, the mandrel rod is neither fully nor partially inserted into the tube blank, is referred to herein as the initial state.

The device further comprises a retaining device having a fixing unit that is movable along the rolling line and is designed to temporarily hold the mandrel rod at an action point in the region of the rear end of the mandrel rod and to carry out a working stroke, starting from a starting position, in the rolling direction and counter to the rolling direction, as a result of which the mandrel rod can be inserted into the rolling mill in the rolling direction and pulled out the rolling mill counter to the rolling direction by the retaining device.

In other words, the object of the retaining device is primarily to retain the mandrel rod after the tube blank has been transported through the rolling mill and to pull it out of the rolling mill counter to the rolling direction. The retaining device can also, at least in part, perform or be involved in the advance of the mandrel rod into the rolling mill. For this purpose, the retaining device has a fixing unit that is designed to temporarily hold or fix, as the case may be, for example clamp, the mandrel rod at the action point. In this connection, the terms "holding" and "fixing," as the case may be, do not mean that the transport of the mandrel rod along the rolling line is stopped, but that there is a temporary fixed connection between the mandrel rod and the fixing unit, such that they do not carry out any relative movement along the rolling line in the fixed state. The mechanism for fixing and releasing the mandrel rod can, in the simplest case, comprise a stop; alternatively, it can be realized as a gripper, by means of clamping jaws or in another suitable manner.

It should be noted that spatial designations such as "rear," "front," "rearward," "forward," etc. refer to the rolling direction and are thus clearly defined.

The retaining device is designed in such a manner that the starting position of the fixing unit in the initial state is between the two ends of the mandrel rod.

In other words, the working stroke of the fixing unit during a machine cycle is no longer composed of the lengths of the tube blank and the mandrel rod, but is shortened in contrast, as a result of which a reduction in the main time of the machine cycle is possible. While the starting position is conventionally located in the region of the rear end of the mandrel rod in the home position, the starting position is shifted forward in the rolling direction in accordance with the innovation described herein, and is located between the front and rear ends of the mandrel rod. Preferably, the fixing unit is not moved back behind the starting position at any time during the regular rolling cycle. The shortening of the working stroke of the retaining device or its fixing unit, as the case may be, for example, corresponds approximately to the length of the tube blank.

By shortening the working stroke in this manner, the mandrel rod can be pre-threaded into the tube blank within the auxiliary time of the machine cycle, as a result of which a reduction in cycle time can be achieved, which can be used to increase production.

Shortening the working stroke of the retaining device also enables the moving mass to be minimized, as a result of which drive power and dynamic loads are reduced.

The positioning and adjustment of the fixing unit as a function of the dimension of the tube blank(s) can be carried out easily and flexibly. This allows the system to be easily pre-positioned for shorter tube blanks to further reduce cycle time.

The process steps of inserting the mandrel rod and inserting the tube blank into the rolling line can be carried out simultaneously or in a manner overlapping in time, as a result of which a further reduction in the cycle time of the machine cycle can be achieved. The removal of the retracted mandrel rod and the insertion of a new tube blank can be carried out along the shortest possible path, immediately one after the other. A transfer device designed for this purpose can be installed in a manner pre-positioned at the shortest possible distance.

By threading the mandrel rod into the tube blank in the rolling line, any temperature loss in the rolled material can be minimized. At the same time, there is less heating of the mandrel rod(s), as a result of which, in turn, the number of mandrel rods in circulation can be minimized.

Preferably, the retaining device is further designed in such a manner that the working stroke of the fixing unit is smaller than the total axial length of the mandrel rod and tube blank. The working stroke can substantially be reduced to the length of the tube blank, as a result of which the cycle time of a machine cycle is minimized.

Preferably, the action point of the mandrel rod is in the form of a joint, wherein this comprises, for example, a local joint, thickening, recess or groove (hereinafter generally referred to as a "joint"). For example, the mandrel rod has, for instance, a section with reduced diameter at the action point, wherein the fixing unit is designed to engage in the joint. In this manner, temporary fixing between the mandrel rod and the fixing unit can be implemented easily and reliably in terms of machine design. Thereby, the fixing unit can, for example, actively engage in the joint by clamping or passively engage and/or strike the joint.

Preferably, the retaining device is designed in such a manner that the fixing unit is released from the mandrel rod in the initial state, such that the mandrel rod, which is to be advanced in the rolling direction by the inserter starting from the initial state, can be moved or displaced, as the case may be, relative to the fixing unit. In such a case, the mandrel rod thus covers a certain distance in the rolling direction, starting from the initial state, until its action point reaches the fixing unit. Thereby, the fixing unit can guide the mandrel rod until fixing occurs relative to one another.

However, while the mandrel rod is advanced relative to the fixing unit in the rolling direction, the fixing unit does not have to remain stationary in place. Rather, the retaining device is preferably designed in such a manner that, during the advance of the inserter in the rolling direction, the fixing unit is moved or accelerated (likewise in the rolling direction) at a lower speed (relative to the mandrel rod), in order to at least partially equalize the speed of the fixing unit and the speed of the mandrel rod. Such a speed equalization or synchronization of the movements, as the case may be, can contribute to a further reduction in the cycle time of the machine cycle and reduce the mechanical load on the components involved. Thereby, during the advance of the mandrel rod, the fixing unit can first remain in the starting position for a certain time before it is accelerated in the rolling direction.

Preferably, the retaining device is designed in such a manner that the fixing unit automatically engages with the action point or the taper, as the case may be, when the action point of the mandrel rod reaches the position of the fixing unit as a result of the advance by means of the inserter. Such engagement position can be the starting position of the fixing unit or, if a speed adjustment is made, can be downstream of it in the rolling direction.

Preferably, the retaining device has a carriage that can be moved parallel to the rolling line and on which the fixing unit is arranged. The retaining device can further comprise an electric motor with a pinion/rack mechanism, by means of which the carriage is driven. The carriage along with the rack are preferably located next to the rolling line. In such a case, the retaining device is designed in such a manner that the installation space on the rolling line remains accessible, such that the mandrel rod can be inserted into the rolling line and removed without having to retract the fixing unit for fixing the mandrel rod from the rear end of the mandrel rod.

Preferably, a connecting device is provided, which is designed to fix the mandrel rod to the inserter in a force-locking manner during forward travel until transfer to the retaining device, wherein the connecting device preferably is mounted on the inserter. In this manner, a safe and reliable transfer of the mandrel rod can be realized even at high machine speeds.

Preferably, the retaining device and the mandrel rod are designed to be coupled in a positive-locking manner to one another after transfer has taken place and to be mechanically decoupled in discretely or continuously adjustable end positions of the retaining device.

The object specified above is further achieved by a rolling plant, which has a rolling mill with one or more rolling stands for rolling seamless tubes and a device for handling mandrel rods in accordance with one of the design variants described above.

The rolling mill is designed as a longitudinal rolling mill, for example with three to eight, preferably five to six, rolling stands and with two to four, preferably three, work rolls per stand, of which at least one roll is driven, preferably all rolls are driven. The term "longitudinal rolling mill" includes elongating rolling mills of all types, such as continuous rolling mills, MPM along with push benches.

The features, technical effects, advantages along with exemplary embodiments described with respect to the device for handling mandrels apply analogously to the rolling plant.

The object specified above is further achieved by a method for rolling seamless tubes with a rolling plant, the method comprising: Inserting a tube blank and a mandrel rod into the rolling line, such that the mandrel rod is located in front of (downstream of) the inserter, the tube blank is located in front of (downstream of) the mandrel rod and the first rolling stand of the rolling mill is located in front of (downstream of) the tube blank, as seen in the rolling direction, as a result of which the mandrel rod is in the initial state; positioning the fixing unit of the retaining device at the starting position that is located between the two ends of the mandrel rod, wherein the fixing unit is released from the mandrel rod in such a manner that the mandrel rod is movable along the rolling line relative to the fixing unit; moving the inserter in the rolling direction, as a result of which the inserter pushes the mandrel rod forward and into the tube blank, wherein a relative displacement takes place between the fixing unit and the mandrel rod; holding the mandrel rod by the fixing unit if the action point of the mandrel rod reaches the position of the fixing unit, such that subsequently no relative movement takes place between the fixing unit and the mandrel rod; transporting the tube blank with inserted mandrel rod through the rolling mill, such that the tube blank is rolled out on the mandrel rod to form the tube; and subsequently retracting the mandrel rod from the rolling mill counter to the rolling direction by the retaining device.

The listing of method steps does not necessarily indicate an order or chronological sequence. For example, the insertion of the tube blank and mandrel rod into the rolling line along with the positioning of the fixing unit can take place one after the other, simultaneously or in a manner overlapping in time.

The features, technical effects, advantages along with exemplary embodiments described with respect to the device for handling mandrel rods along with the rolling plant apply analogously to the method.

Preferably, the transfer of the mandrel rod from the inserter to the retaining device occurs dynamically during the forward movement, wherein the speeds of the two devices are synchronized relative to one another during the transfer.

Preferably, the tube blank and/or the mandrel rod are inserted into the rolling line transversely to the rolling direction, that is, transversely to the axial direction of the tube blank/mandrel rod, as a result of which the loading of the rolling line can be carried out as quickly as possible. This applies equally to the removal of the mandrel rod used in the rolling cycle from the rolling line.

Preferably, for the reasons specified above, during the advance of the mandrel rod in the rolling direction by the inserter, the fixing unit is moved or accelerated at a lower speed (relative to the mandrel rod) to at least partially equalize the speed of the fixing unit and the speed of the mandrel rod in the rolling direction. Thereby, the fixing unit can initially remain in the starting position for a certain time during the advance of the mandrel rod by the inserter before it is accelerated in the rolling direction.

Preferably, the fixing unit holds the mandrel rod in place for the reasons specified above by the fixing unit engaging or striking a taper at the action point of the mandrel rod.

Preferably, following the retraction of the mandrel rod from the rolling mill, a mandrel rod transfer is carried out by releasing the fastening between the fixing unit and the mandrel rod and ejecting the mandrel rod transversely to the rolling line, wherein the ejection preferably takes place at a position different from the initial state. The mandrel rod is normally ejected at a position closer to the rolling mill than its position in the initial state.

Preferably, the tube blank is driven into the mill by a separate driven roll, also known as a "pinch roll."

Further advantages and features of the present invention are apparent from the following description of preferred exemplary embodiments. The features described therein can be implemented alone or in combination with one or more of the features set forth above, provided the features do not contradict one another. The following description of preferred exemplary embodiments is made with reference to the accompanying drawings.

BRIEF DESCRIPTION OF THE DRAWINGS

Preferred further embodiments are explained in more detail by the following description of the figures.

FIG. 2-1 and FIG. 2-2, illustrations a) through n), show a sequence of states that the rolling plant in accordance with FIG. 1 assumes during a machine cycle.

DETAILED DESCRIPTION

Preferred exemplary embodiments are described below with reference to the figures. In this context, identical, similar or similarly acting elements are provided with identical reference signs in the figures, and a repeated description of such elements is partially omitted in order to avoid redundancy.

Figure 1:
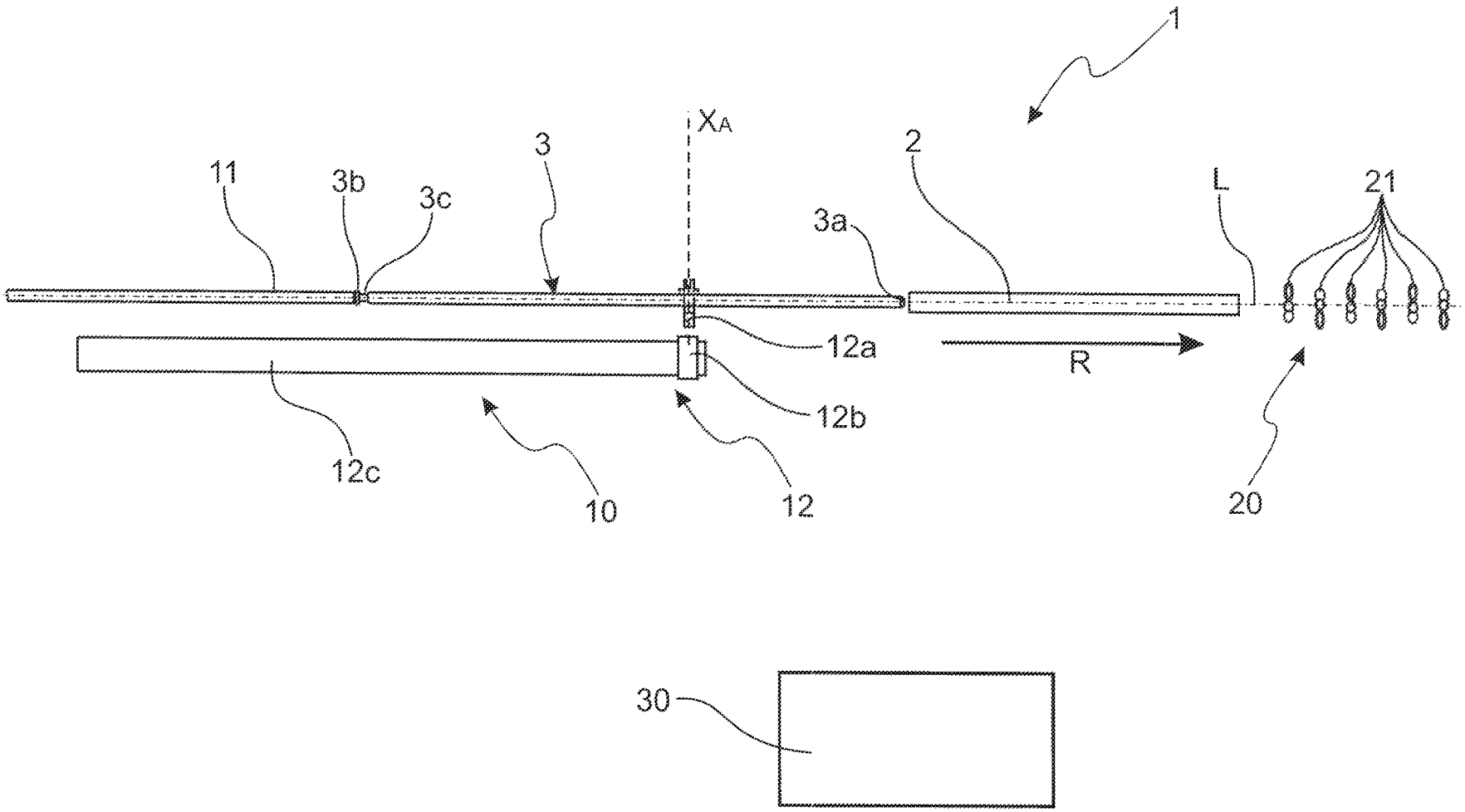
FIG. 1 is a schematic top view of a rolling plant for rolling seamless tubes with a device for handling mandrel rods and a rolling mill.

FIG. 1 is a schematic top view of a rolling plant 1 for rolling a tube blank 2, also referred to herein as "rolled material," "rolled product" or "workpiece," into a tube 2' (see FIG. 2*h*), wherein the rolling plant 1 comprises a device 10 for handling mandrel rods 3 and a rolling mill 20.

The rolling mill 20 has a plurality of rolling stands 21 arranged one behind the other along a rolling direction R, through which the tube blank 2 is transported along a rolling line L together with a threaded mandrel rod 3 and plastically deformed by rolling out the tube blank 2 on the mandrel rod 3 to form the tube 2'.

The rolling mill 20 is preferably designed as a longitudinal rolling mill, for example with three to eight, preferably five to six, rolling stands 21 and with two to four, preferably three, work rolls per stand, of which at least one roll is driven, preferably all rolls are driven. The term "longitudinal rolling mill" includes elongating rolling mills of all types, such as continuous rolling mills, MPM along with push benches. The rolling stands 21 comprise the work rolls specified above, the structure of which is not shown in detail in the figures, which perform the desired forming of the workpiece. A longitudinal advance of the workpiece 2 is effected by two to four, preferably three, work rolls arranged uniformly around the rolled material or the roll center, as the case may be.

In the process stage shown in FIG. 1, both the tube blank 2 and the mandrel rod 3 are already in the rolling line L upstream of the rolling mill 20. The tube blank 2 and the mandrel rod 3 were previously positioned accordingly by a transverse transport. The tube blank 2 is located directly upstream of the first rolling stand 21, preferably at a flush line upstream of the rolling mill 20. The mandrel rod 3 is positioned coaxially upstream of the tube blank 2. The mandrel rod 3 comprises a rounded or slightly tapered tool head at the front end 3*a*, in order to facilitate the threading of the mandrel rod 3 into the tube blank 2. In the region of the rear end 3*b*, the mandrel rod 3 has an action point 3*c* for fixing by the retaining device 12 described below. In accordance with the present exemplary embodiment, the action point 3*c* is formed as a taper, but it is not limited thereto.

The device 10 for handling the mandrel rod 3 comprises an inserter 11, which is also arranged in the rolling line L, upstream of the mandrel rod 3, and a device, not shown in the figures, for actively advancing the inserter 11 in a rolling direction R. In the initial state of FIG. 1, there may be a small safety clearance between the mandrel rod 3 and the inserter 11 in order not to impede the transverse transport of the mandrel rod 3 into the rolling line L.

The device 10 further comprises a retaining device 12, the primary function of which is to retain the mandrel rod 3 after the tube blank 2 has been transported through the rolling mill 20 and to pull it out of the rolling mill 20 in the opposite direction to the rolling direction R. The retaining device 12 can also, at least in part, perform or be involved in advancing the mandrel rod 3 into the rolling mill 20.

For this purpose, the retaining device 12 has a fixing unit 12*a*, which is designed to temporarily fix, for example clamp, the mandrel rod 3 at the action point 3*c*. The mechanism for fixing and releasing the mandrel rod 3 can, in the simplest case, comprise a stop; alternatively, it can be realized as a gripper, by means of clamping jaws or in another suitable manner. The fixing unit 12*a* is designed to move along the rolling line L via a carriage 12*b*. The carriage 12*b* is preferably driven by an electric motor with a pinion/rack mechanism, of which the rack 12*c* is shown schematically in the figures. However, the actuator for moving the carriage 12*b* is not limited to an electromotive pinion/rack mechanism. For example, the retaining device 12 can alternatively be actuated hydraulically or by means of a linear motor.

Figure 3:
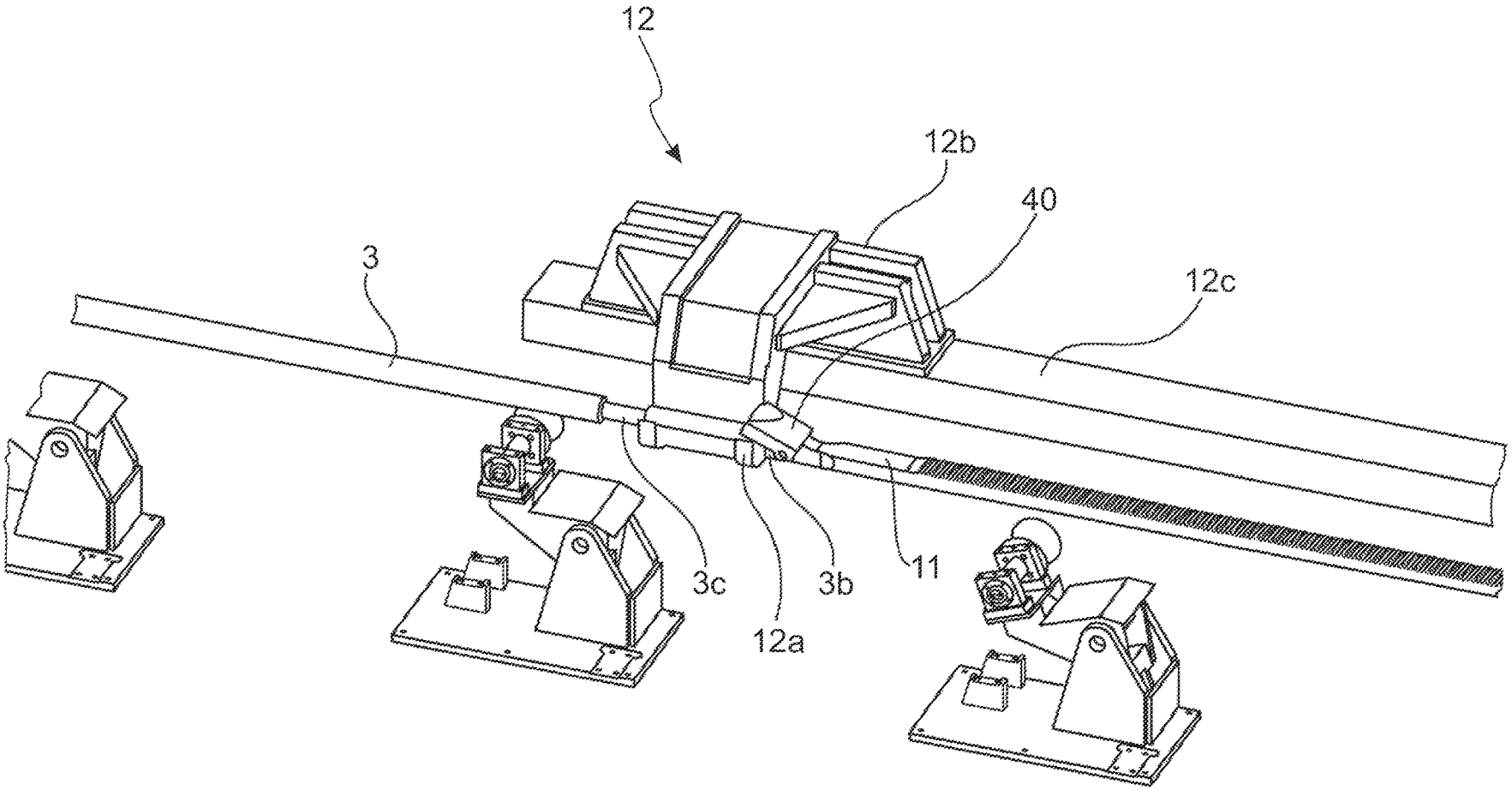
FIG. 3 shows a connecting device mounted on an inserter, which fixes the mandrel rod to the inserter during forward travel until it is transferred to a retaining device.

An additional exemplary embodiment of the retaining device 12 with a connecting device 40 mounted on the inserter 11 is shown in FIG. 3. By means of the connecting device 40, the mandrel rod 3 is fixed in a force-locking manner to the inserter 11 during forward travel until it is transferred to the retaining device 12.

Figures 1, 2:
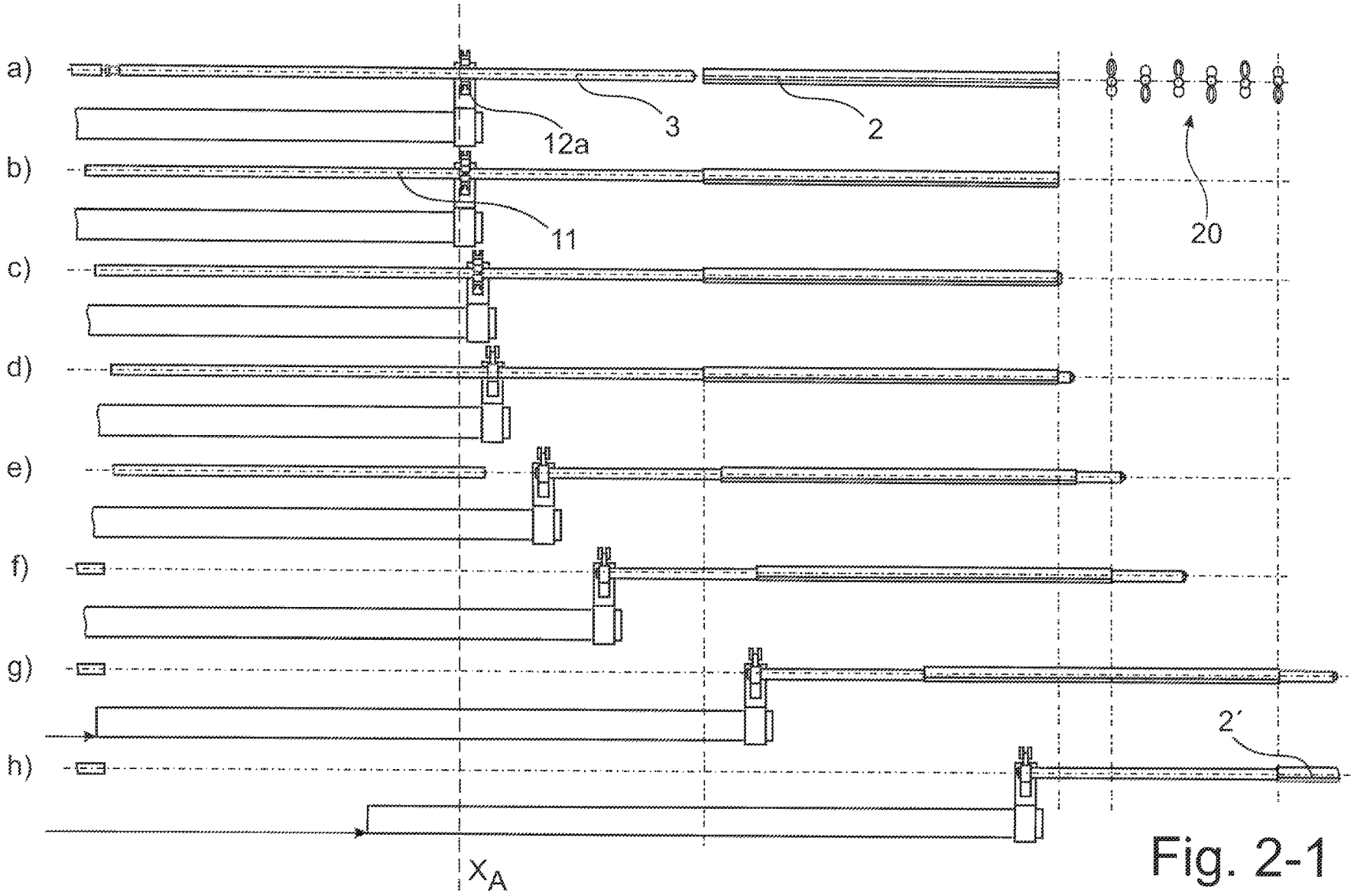
Figure 2:
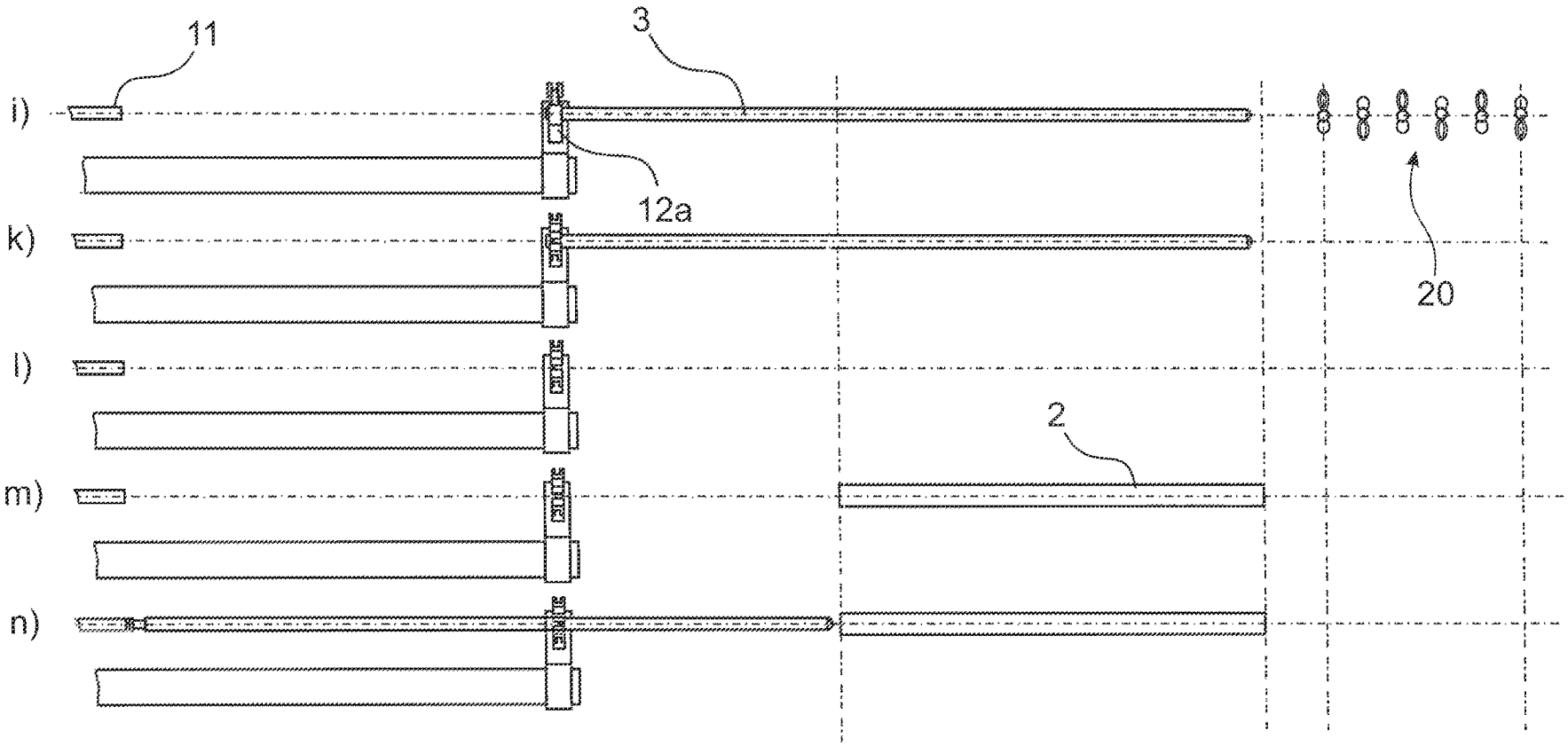

In the following, the process sequence of the rolling plant 1 for one machine cycle is described with reference to FIG. 2. FIG. 2 is divided into sections a) to n), each of which shows a state of the rolling mill 1 in chronological sequence during the machine cycle. For the sake of clarity, the reference signs are partially omitted in FIG. 2.

The starting point is the initial state shown in FIG. 2*a*) (coincides with that of FIG. 1), in which the tube blank 2 and the mandrel rod 3 were inserted into the rolling line L upstream of the rolling mill 20 by means of a transverse transport (not shown in the figure), also referred to herein as mandrel rod transfer stroke. At a starting position $x_A$, the fixing unit 12*a* is in a released state relative to the mandrel rod 3, such that the mandrel rod 3 is freely movable in the rolling direction R relative to the fixing unit 12*a*. In the initial state of FIG. 2*a*), the starting position $x_A$ is located between the two ends of the mandrel rod 3, preferably in the front half of the mandrel rod 3.

Starting from the initial state of FIG. 2*a*), the inserter 11 is moved in a rolling direction R, as a result of which the inserter 11 advances the mandrel rod 3 and threads it into the tube blank 2, see FIG. 2*b*). The fixing unit 12*a* is open in order to allow an advance of the inserter 11 and the mandrel rod 3.

During the advance of the mandrel rod 3, the fixing unit 12*an* initially remains at the starting position $x_A$ and is subsequently accelerated in the rolling direction R in order to achieve a speed equalization between the mandrel rod 3 and the fixing unit 12*a*, as shown in FIG. 2*c*). This stroke is also referred to herein as the mandrel rod synchronization stroke. Thus, during the mandrel rod synchronization stroke, there is a relative movement between the mandrel rod 3 and the fixing unit 12*a*, and the action point 3*c* is not yet directly at the position of the fixing unit 12*a*. Thereby, a complete or partial speed equalization can be aimed at.

When the action point 3*c* of the mandrel rod 3 reaches the position of the fixing unit 12*a*, the fixing unit 12*a* engages or closes, as the case may be, with the action point 3*c* along a mandrel rod clamping stroke, as shown in FIG. 2*d*). At the same time, the mandrel rod 3 completely penetrates the tube blank 2 and enters the rolling mill 20 at the head-side end 3*a*.

After completion of the mandrel rod clamping stroke, the synchronous movement between the inserter 11 and the mandrel rod 3 is rescinded, the further advance of the mandrel rod 3 in a rolling direction R, herein referred to as mandrel rod feed stroke, is taken over by the retaining device 12 and/or by the rolling mill 20, the inserter 11 stops, as a result of which the mandrel rod 3 and the inserter 11 separate from one another, see FIG. 2*e*). At the same time, the tube blank 2 accelerates in a tube blank acceleration stroke in the direction of the first rolling stand 21, wherein the mandrel rod 3 has completely penetrated the tube blank 2 and enters the rolling mill 20 at the front end 3*a*.

FIG. 2*f*) shows the rolling start stroke. The tube blank 2 enters the first rolling stand 21 of the rolling mill 20. At the same time, the inserter 11 is moved back to its starting position, as a result of which it is ready for the next machine cycle.

FIG. 2*g*) shows a state during the rolling of the tube blank 2 in which the tube blank 2 has been advanced to the last rolling stand 21 of the rolling mill, and FIG. 2*h*) shows a state in which the tube blank 2 has left the last rolling stand 21 of the rolling mill 20 and has been completely rolled out on the mandrel rod 3 to form the tube 2'. The mandrel rod 3 has executed a full stroke, herein also referred to as the mandrel rod stroke roller end.

The mandrel rod 3 is subsequently moved out of the rolling mill 20 by the retaining device 12 counter to the rolling direction R and is returned to an ejection position, see FIG. 2*i*).

Subsequently, the mandrel rod transfer stroke is carried out by releasing or unclamping, as the case may be, the fixing of the mandrel rod 3 by the fixing unit 12*a*, see FIG. 2*k*), and subsequently is ejected transversely to the rolling line L, as shown in FIG. 2*l*). Thereafter, a new tube blank 2 and a new mandrel rod 3 are inserted into the rolling line L, see FIGS. 2*m*) and 2*n*). The insertion of the tube blank 2 and the mandrel rod 3 in the mandrel rod transfer stroke can take place one after the other, simultaneously or in a manner overlapping in time.

The process sequence described above can be carried out by a controller 30, which is shown schematically in FIG. 1. For the sake of clarity, the communication paths with corresponding actuators, sensors and the like are not shown.

The controller 30 can form a separate electronic unit, communicate with or be a component of a machine controller, system controller or the like. Communication between the electronic components can be analog or digital, wired or wireless. The controller 30 can be part of Internet-based and/or cloud-based applications or implemented in other manners, and can access databases where appropriate.

The retaining device 12 is designed in such a manner that the installation space in the region of the rolling line L remains accessible, such that the mandrel rod 3 can be inserted into and removed from the rolling line L without having to retract the fixing unit 12*a* for fixing the mandrel rod 3 from the rear end of the mandrel rod 3. In other words, the working stroke of the fixing unit 12*a* during a machine cycle is no longer composed of the lengths of the tube blank 2 and the mandrel rod 3, but is shortened in contrast, as a result of which a reduction in the main time of the machine cycle is possible. While the starting position $x_A$ is conventionally located in the region of the rear end 3*b* of the mandrel rod 3 in the home position, the starting position $x_A$ is shifted forward in the rolling direction R in accordance with the innovation set forth herein, and is located between the front and rear ends 3*a*, 3*b* of the mandrel rod 3. The shortening of the working stroke of the retaining device 12 or its fixing unit 12*a*, as the case may be, for example, corresponds approximately to the length of the tube blank 2.

By shortening the working stroke in this manner, the mandrel rod 3 can be pre-threaded into the tube blank 2 within the auxiliary time of the machine cycle, as a result of which a reduction in cycle time can be achieved, which can be used to increase production.

Shortening the working stroke of the retaining device 12 also enables the moving mass to be minimized, as a result of which drive power and dynamic loads are reduced. The coupling of the retaining device 12 to the mandrel rod 3 in the mandrel rod synchronization stroke helps to further reduce the cycle time of the machine cycle. The positioning and adjustment of the fixing unit 12*a* as a function of the dimension of the tube blank(s) 2 can be carried out easily and flexibly. This allows the system to be easily pre-positioned for shorter tube blanks 2 to further reduce cycle time. The process steps of inserting the mandrel rod 3 and inserting the tube blank 2 into the rolling line L can be carried out simultaneously, as a result of which a further reduction in the cycle time of the machine cycle can be achieved. The removal of the retracted mandrel rod 3 and the insertion of a new tube blank 2 can be carried out along the shortest possible path, immediately one after the other. A transfer device designed for this purpose can be installed in a manner pre-positioned at the shortest possible distance.

By threading the mandrel rod 3 into the tube blank 2 in the rolling line L, any temperature loss in the rolled material can be minimized. At the same time, there is less heating of the mandrel rod(s) 3, as a result of which, in turn, the number of mandrel rods 3 in circulation can be minimized.

To the extent applicable, any of the individual features shown in the exemplary embodiments may be combined and/or interchanged without departing from the scope of the invention.

LIST OF REFERENCE SIGNS

1 Rolling plant
2 Tube blank
2' Rolled out tube
3 Mandrel rod
3*a* Front end of the mandrel rod
3*b* Rear end of mandrel rod
3*c* Action point
10 Device for handling mandrel rods
11 Inserter
12 Retaining device
12*a* Fixing unit
12*b* Carriage
12*c* Rack
20 Rolling mill
21 Rolling stand
30 Controller
40 Connecting device
L Rolling line
R Conveying direction/rolling direction
$x_A$ Starting position

The invention claimed is:

1. A device (10) for handling mandrel rods (3) in a rolling plant (1) having a rolling mill (20) for rolling seamless tubes (2'), the device (10) comprising:

an inserter (11) that is designed to move a mandrel rod (3) arranged in a rolling line (L) in a rolling direction (R) such that the mandrel rod (3), starting from an initial state, is pushed into a tube blank (2) that is arranged downstream of the mandrel rod (3); and a retaining device (12) having a fixing unit (12*a*) that is movable along the rolling line (L) and is designed to temporarily hold the mandrel rod (3) at an action point (3*c*) in a region of a rear end (3*b*) of the mandrel rod (3) and to carry out a working stroke, starting from a starting position ($X_A$), in the rolling direction (R) and counter to the rolling direction (R), as a result of which the mandrel rod (3) is inserted into the rolling mill (20) in the rolling direction (R) and pulled out of the rolling mill (20) counter to the rolling direction (R) by the retaining device (12), wherein the retaining device (12) is designed such that the starting position ($X_A$) of the fixing unit (12*a*) in the initial state is between the rear end (3*b*) and an opposite front end (3*a*) of the mandrel rod (3).

2. The device (10) according to claim 1, wherein the retaining device (12) is designed such that the working stroke of the fixing unit (12*a*) is smaller than a total axial length of the mandrel rod (3) and the tube blank (2) and substantially corresponds to a length of the tube blank (2).

3. The device (10) according to claim 1, wherein the action point (3*c*) of the mandrel rod (3) is designed as a joint and the fixing unit (12*a*) is designed to engage in the joint and/or to strike the joint, wherein the joint comprises a local thickening, a recess and/or a groove.

4. The device (10) according to claim 1, wherein the retaining device (12) is designed such that the fixing unit (12*a*) is released from the mandrel rod (3) in the initial state, whereby, starting from the initial state, the mandrel rod (3) to be advanced by the inserter (11) in the rolling direction (R) is movable relative to the fixing unit (12*a*).

5. The device (10) according to claim 4, wherein the retaining device (12) is designed such that, during advancing of the inserter (11) in the rolling direction (R), the fixing unit (12*a*) is advanced or accelerated at a lower speed relative to the mandrel rod (3), in order to at least partially equalize a speed of the fixing unit (12*a*) and a speed of the mandrel rod (3) in the rolling direction (R).

6. The device (10) according to claim 1, wherein the retaining device (12) is designed such that the fixing unit (12*a*) engages with the action point (3*c*) when the action point (3*c*) of the mandrel rod (3) reaches the position of the fixing unit (12*a*) as a result of advancing by the inserter (11).

7. The device (10) according to claim 1, wherein the retaining device (12) has a carriage (12*b*) that can be moved parallel to the rolling line (L) and on which the fixing unit (12*a*) is arranged, and wherein the retaining device (12) has an electric motor with a pinion/rack mechanism (12*c*), by which the carriage (12*b*) is driven.

8. The device (10) according to claim 1, wherein a connecting device (40) is provided, which is designed to fix the mandrel rod (3) to the inserter (11) in a force-locking manner during forward travel until transfer to the retaining device (12), and wherein the connecting device (40) is mounted on the inserter (11).

9. The device according to claim 1, wherein the retaining device (12) and the mandrel rod (3) are designed to be coupled in a positive-locking manner to one another after transfer has taken place and to be mechanically decoupled in discretely or continuously adjustable end positions of the retaining device (12).

10. A rolling plant (1) with a rolling mill (20) comprising one or more rolling stands (21) for rolling seamless tubes (2') and the device (10) for handling mandrel rods (3) according to claim 1, wherein the rolling mill (20) is designed as a longitudinal rolling mill.

11. The rolling plant (1) according to claim 10, wherein the rolling mill (20) is designed as a longitudinal rolling mill with three to eight rolling stands (21) and with two to four work rolls per rolling stand (21), wherein at least one of the work rolls is driven.

12. A method of rolling seamless tubes (2'), comprising:

inserting a tube blank (2) and a mandrel rod (3) into a rolling line (L), such that the mandrel rod (3) is located downstream of an inserter (11), the tube blank (2) is located downstream of the mandrel rod (3), and a first rolling stand (21) of a rolling mill (20) is located downstream of the tube blank (2), as a result of which the mandrel rod (3) is in an initial state;

positioning a fixing unit (12*a*) of a retaining device (12) at a starting position ($X^A$) that is located between two ends (3*a*, 3*b*) of the mandrel rod (3), wherein the fixing unit (12*a*) is released from the mandrel rod (3) in such a manner that the mandrel rod (3) is movable along the rolling line (L) relative to the fixing unit (12*a*);

moving the inserter (11) in a rolling direction (R), as a result of which the inserter (11) pushes the mandrel rod (3) forward and into the tube blank (2), wherein a relative displacement takes place between the fixing unit (12*a*) and the mandrel rod (3);

holding the mandrel rod (3) by the fixing unit (12*a*) if an action point (3*c*) of the mandrel rod (3) reaches the position of the fixing unit (12*a*), such that subsequently no relative movement takes place between the fixing unit (12*a*) and the mandrel rod (3);

transporting the tube blank (2) with the mandrel rod (3) inserted through the rolling mill (20), such that the tube blank (2) is rolled out on the mandrel rod (3) to form a tube (2'); and subsequently retracting the mandrel rod (3) from the rolling mill (20) counter to the rolling direction (R) by the retaining device (12).

13. The method according to claim 12, wherein a transfer of the mandrel rod (3) from the inserter (11) to the retaining device (12) occurs dynamically during a forward movement, wherein speeds of the mandrel rod (3) and the retaining device (12) are synchronized during the transfer.

14. The method according to claim 12, wherein the tube blank (2) and/or the mandrel rod (3) are inserted into the rolling line (L) transversely to the rolling direction (R).

15. The method according to claim 12, wherein, during advancing of the mandrel rod (3) in the rolling direction (R) by the inserter (11), the fixing unit (12*a*) is advanced or accelerated at a lower speed relative to the mandrel rod (3) in order to partially or completely equalize a speed of the fixing unit (12*a*) and a speed of the mandrel rod (3) in the rolling direction (R).

16. The method according to claim 15, wherein, during advancing of the mandrel rod (3) in the rolling direction (R) by the inserter (11), the fixing unit (12*a*) initially remains at the starting position ($X_A$) before it is accelerated in the rolling direction (R).

17. The method according to claim 12, wherein the fixing unit (12*a*) holds the mandrel rod (3) in place by the fixing unit (12*a*) engaging or striking a taper at the action point (3*c*) of the mandrel rod (3).

18. The method according to claim 12, wherein, following the retracting of the mandrel rod (3) from the rolling mill (20), a mandrel rod transfer is carried out by releasing a fastening between the fixing unit (12*a*) and the mandrel rod (3) and ejecting the mandrel rod (3) transversely to the rolling line (L), wherein the ejecting take place at a position different from the initial state.

19. The method according to claim 12, wherein the tube blank (2) is driven into the rolling mill (20) by a separate, driven roll.

* * * * *